US005097995A

United States Patent [19]

Zybok et al.

[11] Patent Number: 5,097,995

[45] Date of Patent: Mar. 24, 1992

[54] FLOW STARTING TUBE FOR INITIATING THE FLOW OF MOLTEN MATERIAL FROM A VESSEL

[75] Inventors: Clemens Zybok, Klein-Winternheim; Manfred Winkelmann; Manfred Berndt, both of Krefeld, all of Fed. Rep. of Germany; Rolf Waltenspühl, Hünenberg; Armin Kursfeld, Cham, both of Switzerland; Udo Muschner, Tönisvorst, Fed. Rep. of Germany

[73] Assignees: Stopinc Aktiengesellschaft, Baar, Switzerland; Didier-Werke AG, Wiesbaden, Fed. Rep. of Germany

[21] Appl. No.: 689,735

[22] Filed: Apr. 24, 1991

Related U.S. Application Data

[63] Continuation of Ser. No. 143,053, Jan. 12, 1988, abandoned.

[30] Foreign Application Priority Data

Jan. 22, 1987 [DE] Fed. Rep. of Germany ..... 3701701

[51] Int. Cl.[5] ..... B22D 41/08

[52] U.S. Cl. ..... 222/594; 164/437

[58] Field of Search ..... 222/594, 595, 591, 592, 222/593, 603; 164/335, 337, 437, 133

[56] References Cited

U.S. PATENT DOCUMENTS 4,479,594 10/1984 Altland ..... 164/437

FOREIGN PATENT DOCUMENTS 57-51172 3/1982 Japan ..... 222/591

*Primary Examiner*—Robert P. Olszewski
*Assistant Examiner*—Kenneth Noland
*Attorney, Agent, or Firm*—Wenderoth, Lind & Ponack

[57] ABSTRACT

A flow starting tube for initiating the discharge flow of molten material in a vessel through a bottom discharge opening thereof extends upwardly from a lower end fitted to the discharge opening to thereby block access of the molten material to the discharge opening. The flow starting tube has a configuration such that it is broken away at a predetermined breaking position when the level of molten material in the vessel reaches a suitable level. Such breaking away at the predetermined breaking position is achieved under the influence of the molten material burning through the flow starting tube at the predetermined breaking position and/or the influence of the buoyancy in the molten material of a portion of the flow starting tube above the predetermined breaking position.

31 Claims, 3 Drawing Sheets

FLOW STARTING TUBE FOR INITIATING THE FLOW OF MOLTEN MATERIAL FROM A VESSEL

This application is a continuation of now abandoned application, Ser. No. 07/143,053, filed Jan. 12, 1988.

BACKGROUND OF THE INVENTION

The present invention relates to a flow starting tube, i.e. a pipe or tube for initiating the flow of a molten material from a vessel through a bottom discharge opening thereof, the flow starting tube extending upwardly from a lower end to be fitted to the discharge opening to thereby block access of the molten material to the discharge opening, and wherein when the level of molten material in the vessel reaches a suitable level then at least an upper portion of the flow starting tube is separated or removed, whereafter the molten material then has access to the discharge opening and flows downwardly therethrough from the vessel.

The flow starting tube of the present invention is employable in any molten material environment, but particularly is employable for initiating the discharge flow of molten metal from a metallurgical vessel, and it further is particularly contemplated that the present invention be employed for initiating the discharge of molten steel from a tundish through a slide gate or sliding closure unit in a casting operation. In such use, for casting start-up to occur successfully, it is necessary that the flow starting tube release into the pouring channel the molten steel virtually under impact conditions, i.e. as a sudden burst or flow or a sudden substantially full flow. In the past, it has been conventional, when starting the discharge flow of molten steel, to manually break away the upper part of the flow starting tube, for example by means of a metal bar. Such an arrangement however has a number of disadvantages. Particularly, such procedure is dangerous. Furthermore, in a multistrand steel casting plant such a procedure must be carried out a number of times simultaneously. Furthermore, if the tundish or melting vessel is covered, manual breaking away of the flow starting tube is extremely difficult, if not impossible.

SUMMARY OF THE INVENTION

Accordingly, it is an object of the present invention to provide a flow starting tube for initiating the discharge flow of molten material, particularly molten metal and further particularly molten steel, in a vessel, particularly a metallurgical vessel and further particularly a tundish, through a bottom discharge opening thereof, particularly through a slide gate or sliding closure unit already moved to its open position, whereby it is possible to automatically initiate the discharge flow of molten material when the molten material reaches a particular predetermined level in the vessel that is suitable for such discharge flow.

It is a further object of the present invention to provide such a flow starting tube whereby it is possible to overcome the above discussed and other prior art disadvantages.

These objects are achieved in accordance with the present invention by the provision in the structure of the flow starting tube of means for causing breaking away of at least an upper portion of the flow starting tube at a predetermined breaking position, such breaking position extending around the circumference of the flow starting tube at a level below the upper level of molten material in the vessel, and such breaking away being caused by and under the influence of at least one of the molten material burning through the flow starting tube at the predetermined breaking position and the buoyancy in the molten material of a portion of the flow starting tube above the predetermined breaking position. Thus, in accordance with the present invention, the flow starting tube has a construction such that breaking away of at least an upper portion thereof occurs at a predetermined breaking position, and such breaking away occurs automatically when the level of molten material in the melting vessel reaches a predetermined level. Further, such breaking away occurs by the molten material burning through the flow starting tube at the predetermined breaking position and/or due to buoyancy in the molten material of a portion of the flow starting tube above the predetermined breaking position imparting a tensile stress to the flow starting tube, such tensile stress being concentrated at the predetermined breaking position.

Thus, in accordance with the present invention, a given vessel, such as a steel tundish, may be provided with a flow starting tube or a plurality of such flow starting tubes, the discharge flow of the melt being automatically initiated under substantial impact conditions, i.e. under sudden substantially full flow conditions, as soon as the melt reaches a predetermined level in the vessel. Manual intervention to achieve separation or breaking away of the flow starting tube therefore is unnecessary in accordance with the present invention. Furthermore, it is possible to ensure that breaking away occurs substantially simultaneously in a plurality of flow starting tubes.

The predetermined breaking point can be so designed that it is burnt through only by the molten charge acting thereon, thereby initiating the discharge of the molten material into, for example, the entry section of a sliding closure unit. The portion or section of the tube located above the predetermined breaking point then floats away by itself.

Additionally however, the predetermined breaking position can be designed such that breaking away can be achieved by the buoyancy in the molten material of a portion of the flow starting tube above the predetermined breaking position. Breaking away can be achieved substantially due to such buoyancy force, but it particularly is preferable to employ such buoyancy force in conjunction with the molten material burning through the predetermined breaking position, since thereby the predetermined breaking position is subjected to summed forces.

The predetermined breaking position may be defined by an annular recess formed in the flow starting tube and extending inwardly from the outer surface thereof, such that the burning away by the molten material occurs positively in the direction of breakthrough. The annular recess may include an inner cylindrical surface, but other recess configurations are possible.

In accordance with a further feature of the present invention, the portion of the flow starting tube above the predetermined breaking position is enlarged outwardly, such that there is defined an annular, outwardly extending lower surface of the enlarged portion at a position below the upper level of the molten material. As a result, the molten material exerts an upward buoyancy force on the lower surface, thereby imparting to the flow starting tube a tensile force concentrated at the predetermined breaking position. In one arrangement of the present invention, the enlarged portion has a cylindrical configuration, and the lower surface extends substantially horizontally. However, it further is possible to provide that the lower surface has a configuration to enable an increasing area thereof to be acted on by the molten material as the level of molten material in the vessel increases, thereby imparting to the flow starting tube an increasing tensile force. Such lower surface may extend conically outwardly and upwardly.

Additionally however, the lower surface may have a sawtooth configuration including plural surfaces inclined to the horizontal, such that the upward buoyancy force acting on the incline plural surfaces additionally imparts to the enlarged portion of the flow starting tube a rotational force, thereby further subjecting the predetermined breaking position to an additional load.

In accordance with a further feature of the present invention, the flow starting tube below the predetermined breaking position may be a cylindrical member, and the enlarged portion above the predetermined breaking position may be in the form of a conical member formed separately from the cylindrical member and joined thereto at a joint which thus forms the predetermined breaking position.

In accordance with a further feature of the present invention, the predetermined breaking position is located adjacent the lower end of the flow starting tube, thereby preventing slag and impurities in the molten material from entering the bottom discharge opening.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
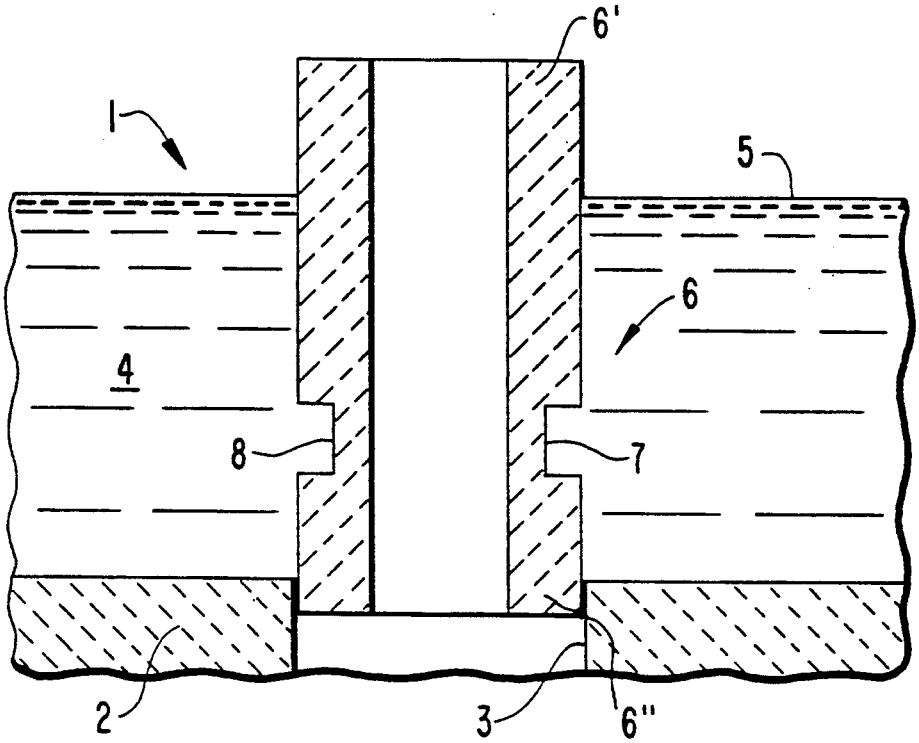
FIG. 1 is a schematic sectional view showing a flow starting tube according to a first embodiment of the present invention positioned in the bottom of a vessel containing molten material.

In FIG. 1 there is shown a portion of the bottom 2 of a melting vessel 1, for example a tundish, with a discharge opening 3 extending through bottom 2 and with the vessel containing molten material, for example molten steel 4, having an upper level 5. A flow starting tube 6 has a lower end fitted to, for example fitted within, discharge opening 3. Flow starting tube 6 extends upwardly to above the upper level 5 of the molten material and therefore blocks access of the molten material to discharge opening 3. It is intended that the lower end of flow starting tube 6 be fitted to discharge opening 3 in a conventional manner.

In accordance with the present invention, the flow starting tube has formed therein a predetermined breaking position 7 extending around the circumference of the flow starting tube at a level below the upper level 5 of molten material 4. In the embodiment of FIG. 1, the predetermined breaking position 7 is in the form of an annular recess extending inwardly from the outer surface of the flow starting tube 6. The annular recess includes an inner cylindrical surface 8, but other configurations of the recess are possible. At a predetermined time, which is a function of the level of molten material, i.e. the time to which predetermined breaking position has been subjected to the action of the molten steel, the molten steel will burn through the material of the flow starting tube at the position 7. Due to the configuration of the recess, the molten steel acts positively in the direction of breakthrough. The molten steel attacks the material of the tube so that after a certain period of time the predetermined breaking position is burnt through. At such time the upper tube section 6' is separated from the lower section 6'', the upper tube section 6' floats away therefrom, and the molten steel 4 thus suddenly breaks through to the discharge opening 3. Such breakthrough is under impact conditions, i.e. the flow of molten steel will be sudden and will be at substantially full flow conditions.

In the embodiment of FIG. 1, the outer surface of the flow starting tube 6 is substantially uniformly continuous, such that breakthrough of the predetermined breaking position occurs as indicated above, i.e. by the molten steel burning therethrough, and without any substantial upward buoyancy force.

Figure 2:
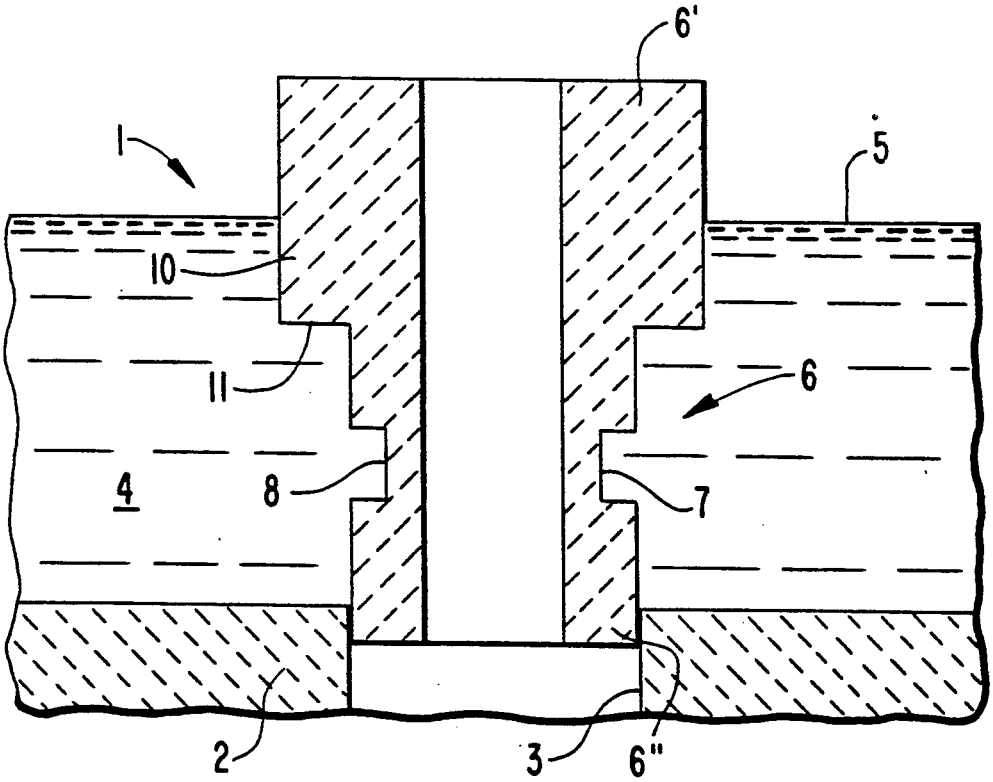
FIGS. 2–4 are views similar to FIG. 1, but illustrating further embodiments of the present invention.

In the embodiment of FIG. 2 however, a portion of the flow starting tube above the predetermined breaking position 7 is enlarged outwardly as indicated at 10 to define an annular outwardly extending lower surface 11 at a position below the upper level 5 of the molten steel. Thus, the molten steel exerts an upward buoyancy force on lower surface 11, and this imparts to the flow starting tube 6 a tensile force that is concentrated at predetermined breaking position 7. Such concentrated tensile force is added to the influence of the molten steel burning through at predetermined breaking position 7, and essentially allows the molten steel to act chemically thereon. As shown in FIG. 2, the enlarged portion 10 is substantially cylindrical, and surface 11 extends substantially horizontally. Other configurations however are possible.

Figure 3:
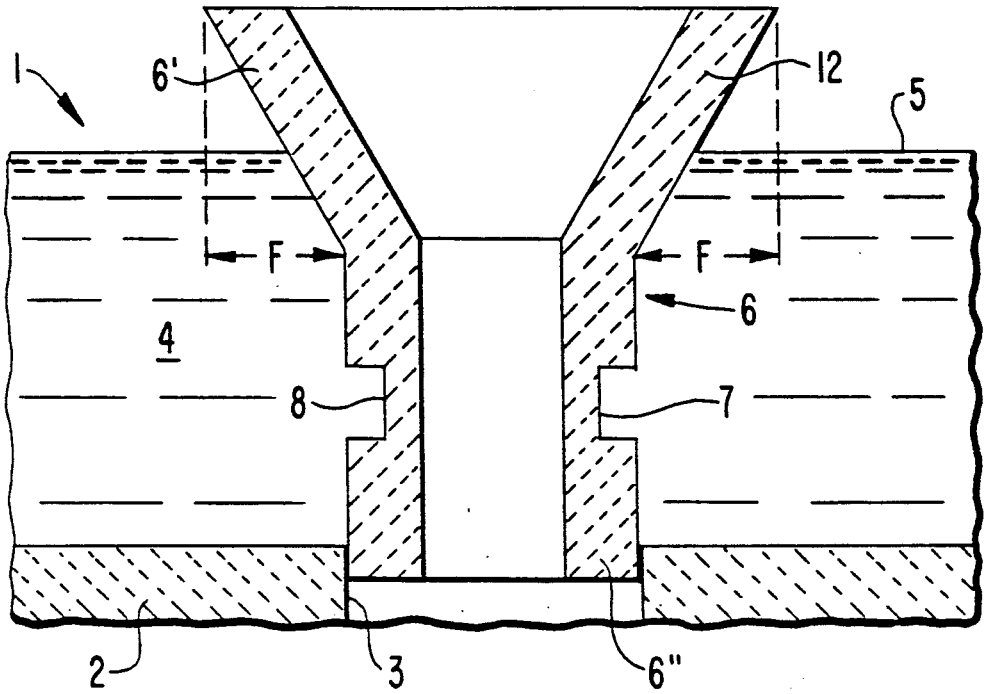

In the embodiment of FIG. 3, the enlarged portion 12 has a lower surface extending conically outwardly and upwardly, such that when the level of the molten steel reaches the juncture of such lower surface and the cylindrical portion of the flow starting tube, the molten steel begins to exert an upward buoyancy force on the enlarged portion 12. Due to the conical configuration of the lower surface, an increasing area thereof (the maximum area being shown as F) is acted on by the molten steel as the level of the molten steel in the vessel increases, thereby imparting to the flow starting tube an increasing tensile force. Upon breakthrough at the predetermined breaking position 7, the discharge flow occurs at even increased impact or sudden flow conditions.

Figure 4:
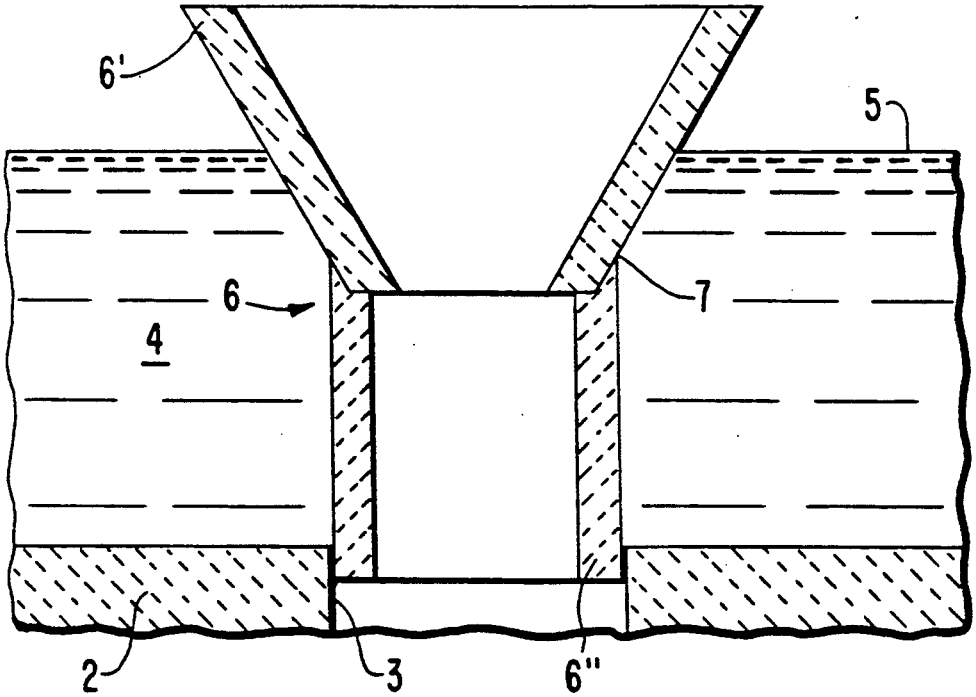

FIG. 4 illustrates a modified embodiment wherein the predetermined breaking position 7 is not formed by a recess. Rather, the flow starting tube portion 6'' below the predetermined breaking position comprises a cylindrical member, and the enlarged portion 6' above the predetermined breaking position comprises a conical member formed separately from the cylindrical member and joined thereto at a joint. Such joint itself forms the predetermined breaking position. The joint may be formed by a suitable bond as would be understood by those skilled in the art. Upon the level of the molten steel rising, an increasing upwardly buoyancy force is exerted on the conical member, thereby causing the bond at the junction 7 to be broken when junction 7 is subjected to a tensile force representative of a predetermined level and separating the conical member from the cylindrical member.

Figure 5:
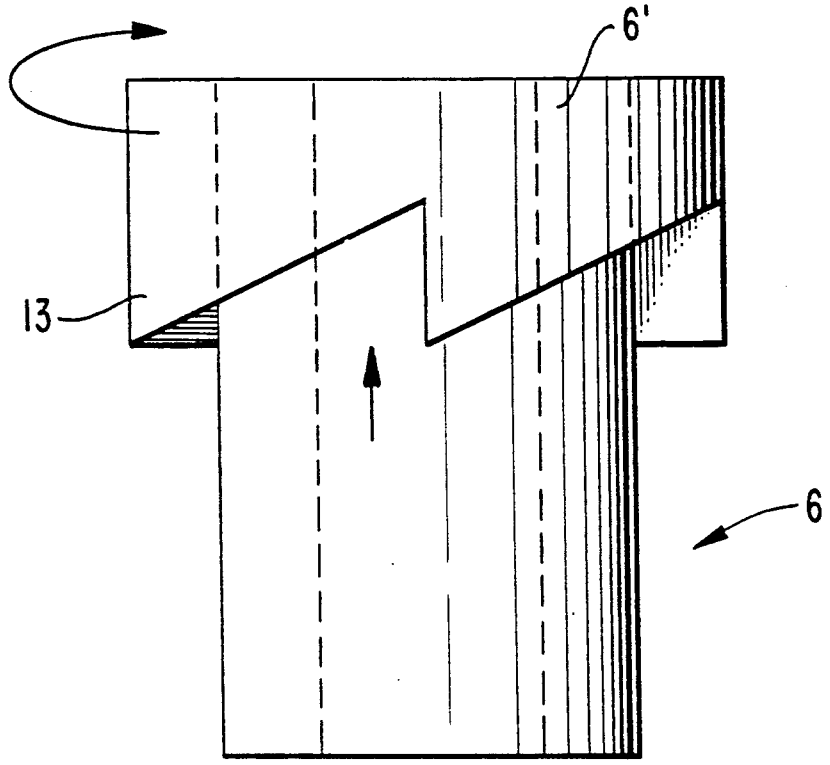
FIG. 5 is an elevation view of a still further embodiment of the present invention.
Figure 6:
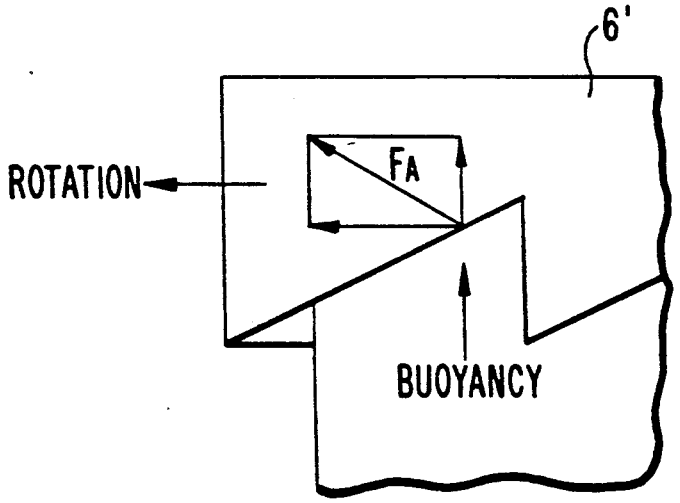
FIG. 6 is a view of a portion of the arrangement of FIG. 5 and further illustrating a vector diagram showing the forces operating thereon.

FIG. 5 shows a further embodiment of the present invention wherein the lower surface of the enlarged portion 13 has a cylindrical sawtooth configuration formed by a plurality of surfaces or surface portions inclined to the horizontal. As a result, the upward buoyancy force acting on the inclined plural surfaces additionally imparts to the enlarged portion a rotational force. FIG. 6 indicates a vector diagram showing the forces acting on the enlarged portion 13 and specifically the resultant force $F_A$ acting in a combined upward and rotational direction. This embodiment of the present invention thus imparts an additional force, i.e. a rotational force, to the previously discussed buoyancy force. This achieves a further intensification of the breaking away force. FIG. 5 further illustrates an arrangement whereby the predetermined breaking point would actually result in removal of the entire flow starting tube 6 from the discharge opening 3. Such an arrangement similarly could be employed in the other embodiments of the present invention. It furthermore however, would be possible to provide the embodiment of FIG. 5 with a predetermined breaking position 7 such as formed by the recess illustrated in FIGS. 1-3 or by a bonded joint as indicated in FIG. 4.

One of ordinary skill in the art readily would understand the materials which could be employed to form the flow starting tube of the present invention. Such materials could be materials known in the art for such purpose, for example low quality ceramics. Such materials of course would be materials capable of breaking away under the forces discussed above and in the manner discussed above.

Furthermore, the location and dimensions of the predetermined breaking position could be determined in a manner readily understood by those skilled in the art from a consideration of the present disclosure. Such would be influenced by a number of factors clearly recognizable by those skilled in the art and including, but not limited to, the composition of the molten material, the composition of the material of the flow starting tube, the buoyancy force imparted in a particular installation, etc. One of ordinary skill in the art would understand from the present disclosure how to employ such factors and other factors to determine dimensions and/or position of the predetermined breaking position to achieve breakthrough thereof at a particular desired time and under particular operating conditions.

Although the present invention has been described and illustrated with respect to preferred features thereof, it is to be understood that various modifications and changes may be made to the specifically described and illustrated features without departing from the scope of the present invention.

We claim:

1. In a flow starting tube for initiating the discharge flow of molten material in a vessel through a bottom discharge opening thereof, said flow starting tube extending upwardly from a lower end to be fitted to the discharge opening to thereby block access of the molten material to the discharge opening, wherein when the level of molten material in the vessel reaches a suitable level at least an upper portion of the flow starting tube is removed, whereupon the molten material then has access to and flows downwardly through the discharge opening, the improvement comprising:

means for enabling the buoyancy in the molten material of a portion of said flow starting tube above a predetermined breaking position, extending around the circumference of said flow starting tube at a level to be below the upper level of molten material in the vessel, to cause a breaking away of said portion of said flow starting tube above said predetermined breaking position.

2. The improvement claimed in claim 1, wherein aid means comprises an annular recess formed in said flow starting tube and extending inwardly from the outer surface thereof, said annular recess defining said predetermined breaking position.

3. The improvement claimed in claim 2, wherein said annular recess includes an inner cylindrical surface.

4. The improvement claimed in claim 2, wherein said portion of said flow starting tube above said predetermined breaking position is enlarged outwardly, and said means further comprises an annular outwardly extending lower surface of said enlarged portion at a position to be below the upper level of the molten material, such that the molten material exerts an upward buoyancy force on said lower surface, thereby imparting to said flow starting tube a tensile force concentrated at said predetermined breaking position.

5. The improvement claimed in claim 4, wherein said enlarged portion has a cylindrical configuration, and said lower surface extends substantially horizontally.

6. The improvement claimed in claim 4, wherein said lower surface has a configuration to enable an increasing area thereof to be acted on by the molten material as the level of molten material in the vessel increases, thereby imparting to said flow starting tube an increasing tensile force.

7. The improvement claimed in claim 6, wherein said lower surface extends conically outwardly and upwardly.

8. The improvement claimed in claim 4, wherein said lower surface has a sawtooth configuration including plural surfaces inclined to the horizontal, such that the upward buoyancy force acting on said inclined plural surfaces additionally imparts to said enlarged portion of said flow starting tube a rotational force.

9. The improvement claimed in claim 1, wherein said portion of said flow starting tube above said predetermined breaking position is enlarged outwardly, and said means comprises an annular, outwardly extending lower surface of said enlarged portion at a position to be below the upper level of the molten material, such that the molten material exerts an upward buoyancy force on said lower surface, thereby imparting to said flow starting tube a tensile force concentrated at said predetermined breaking position.

10. The improvement claimed in claim 9, wherein said enlarged portion has a cylindrical configuration, and said lower surface extends substantially horizontally.

11. The improvement claimed in claim 9, wherein said lower surface has a configuration to enable an increasing area thereof to be acted on by the molten material as the level of molten material in the vessel increases, thereby imparting to said flow starting tube an increasing tensile force.

12. The improvement claimed in claim 11, wherein said lower surface extends conically outwardly and upwardly.

13. The improvement claimed in claim 12, wherein said flow starting tube below said predetermined breaking position comprises a cylindrical member, and said enlarged portion comprises a conical member formed separately from said cylindrical member and joined thereto at a joint forming said predetermined breaking position.

14. The improvement claimed in claim 9, wherein said lower surface has a sawtooth configuration including plural surfaces inclined to the horizontal, such that the upward buoyancy force acting on said inclined plural surfaces additionally imparts to said enlarged portion of said flow starting tube a rotational force.

15. The improvement claimed in claim 1, wherein said predetermined breaking position is located adjacent said lower end of said flow starting tube.

16. In a flow starting tube for initiating the discharge flow of molten material in a vessel through a bottom discharge opening thereof, said flow starting tube extending upwardly from a lower end to be fitted to the discharge opening to thereby block access of the molten material to the discharge opening, wherein when the level of molten material in the vessel reaches a suitable level at least an upper portion of the flow starting tube is removed, whereupon the molten material then has access to and flows downwardly through the discharge opening, the improvement comprising:

means for cuasing breaking away of said at least upper portion of said flow starting tube at a predetermined breaking position, extending around the circumference of said flow starting tube at a level to be below the upper level of molten material in the vessel, under the influence of the buoyancy in the molten material of a portion of said flow startint tube above said predetermined breaking position, wherein said means comprising an annular recess formed in said flow starting tube and extending inwardly from the outer surface thereof, said annular recess defining said predetermined breaking position, said portion of said flow starting tube above said predetermined brekaing position being enlarged outwardly, and said means further comprising an annular outwardly extending lower surface of said enlarged portion at a position to be below the upper level of the molten material, such that the molten material exerts an upward buoyancy force on said lower surface, thereby imparting to said flow starting tube a tensile force concentrated at said predetermined breaking position.

17. The improvement claimed in claim 16, wherein said annular recess includes an inner cylindrical surface.

18. The improvement claimed in claim 16, wherein said enlarged portion has a cylindrical configuration, and said lower surface extends substantially horizontally.

19. The improvement claimed in claim 16, wherein said lower surface has a configuration to enable an increasing area thereof to be acted on by the molten material as the level of molten material in the vessel increases, thereby imparting to said flow starting tube an increasing tensile force.

20. The improvement claimed in claim 19, wherein said lower surface extends conically outwardly and upwardly.

21. The improvement claimed in claim 16, wherein said lower surface has a sawtooth configuration including plural surfaces inclined to a horizontal, such that the upward buoyancy force acting on said inclined plural surfaces additionally imparts to said enlarged portion of said flow starting tube a rotational force.

22. The improvement claimed in claim 16, wherein said predetermined breaking position is located adjacent said lower end of said flow starting tube.

23. In a flow starting tube for initiating the discharge flow of molten material in a vessel through a bottom discharge opening thereof, said flow starting tube extending upwardly from a lower end to be fitted to the discharge opening to thereby block access of the molten material to the discharge opening, wherein when the level of molten material in the vessel reaches a suitable level at least an upper portion of the flow starting tube is removed, whereupon the molten material then has access to and flows downwardly through the discharge opening, the improvement comprising:

means for cuasing breaking away of said at least upper portion of said flow starting tube at a predetermined breaking position, extending around the circumference of said flow starting tube at a level to be below the upper level of molten material in the vessel, under the influence of the buoyancy in the molten material of a portion of said flow startint tube above said predetermined breaking position, said portion of said flow starting tube above said predetermined breaking position being enlarged outwardly, and said means comprising an annular, outwardly extending lower surface of said enlarged portion at a position to be below the upper level of the molten material, such that the molten material exerts an upward buoyancy force on said lower surface, thereby imparting to said flow starting tube a tensile force concentrated at said predetermined breaking position.

24. The improvement claimed in claim 23, wherein said enlarged portion has a cylindrical configuration, and said lower surface extends substantially horizontally.

25. The improvement claimed in claim 23, wherein said lower surface has a configuration to enable an increasing area thereof to be acted on by the molten material as the level of molten material in the vessel increases, thereby imparting to said flow starting tube an increasing tensile force.

26. The improvement claimed in claim 25, wherein said lower surface extends conically outwardly and upwardly.

27. The improvement claimed in claim 26, wherein said flow starting tube below said predetermined breaking position comprises a cylindrical member, sand said enlarged portion comprises a conical member formed separately from said cylindrical member and joined thereto at a joint forming said predetermined breaking position.

28. The improvement claimed in claim 23, wherein said lower surface has a sawtooth configuration including plural surfaces inclined to the horizontal, such that the upward buoyancy force acting on said inclined plural surfaces additionally imparts to said enlarged portion of said flow starting tube a rotational force.

29. The improvement claimed in claim 23, wherein said predetermined breaking position is located adjacent said lower end of said flow starting tube.

30. The improvement claimed in claim 23, wherein said means comprises an annular recess formed in said flow starting tube and extending inwardly from said outer surface thereof, said annular recess defining said predetermined breaking position.

31. The improvement claimed in claim 29, wherein said annular recess includes an inner cylindrical surface.

* * * * *